US011043767B2

(12) United States Patent
Martins et al.

(10) Patent No.: US 11,043,767 B2
(45) Date of Patent: Jun. 22, 2021

(54) METHOD OF FORMING AN ELECTRICAL TERMINAL AND AN ELECTRICAL TERMINAL ASSEMBLY

(71) Applicant: Antaya Techologies Corporation, Warwick, RI (US)

(72) Inventors: David B. Martins, Fall River, MA (US); Marco M. Lucci, Cranston, RI (US); Timothy S. Craven, West Warwick, RI (US); Michael J. Palombo, Warwick, RI (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/863,925

(22) Filed: Apr. 30, 2020

(65) Prior Publication Data

US 2020/0313329 A1 Oct. 1, 2020

Related U.S. Application Data

(62) Division of application No. 16/364,547, filed on Mar. 26, 2019, now Pat. No. 10,680,370.

(51) Int. Cl.

| | |
|---|---|
| ***H01R 9/24*** | (2006.01) |
| ***H01R 13/11*** | (2006.01) |
| ***H01R 11/28*** | (2006.01) |
| ***H01R 13/05*** | (2006.01) |
| ***H01R 13/20*** | (2006.01) |
| ***H01R 13/639*** | (2006.01) |
| ***H01R 4/58*** | (2006.01) |

(52) U.S. Cl.

CPC ..... *H01R 13/111* (2013.01); *H01R 4/58* (2013.01); *H01R 11/282* (2013.01); *H01R 13/052* (2013.01); *H01R 13/20* (2013.01); *H01R 13/639* (2013.01)

(58) Field of Classification Search

CPC ..... H01R 12/00; B21D 53/36; G01R 31/00; H01H 11/04; H01H 43/16; H01H 43/20; H01H 43/24

USPC ..... 439/885, 854, 855, 860, 909, 859; 29/874

See application file for complete search history.

(56) References Cited

U.S. PATENT DOCUMENTS

| | | | | |
|---|---|---|---|---|
| 4,024,953 | A | 5/1977 | Nailor, III | |
| 5,730,629 | A * | 3/1998 | Samejima | H01R 13/113 29/874 |
| 5,897,406 | A * | 4/1999 | Benes | H05B 3/84 439/859 |
| 5,980,338 | A | 11/1999 | Le Pottier et al. | |
| 6,039,616 | A | 3/2000 | Pereira et al. | |
| 6,249,966 | B1 | 6/2001 | Pereira et al. | |
| 6,475,043 | B2 | 11/2002 | Pereira et al. | |
| 6,599,156 | B2 | 7/2003 | Pereira et al. | |
| 6,599,157 | B2 | 7/2003 | Pereira et al. | |

(Continued)

*Primary Examiner* — Phuong K Dinh

(74) *Attorney, Agent, or Firm* — Billion & Armitage

(57) ABSTRACT

A method of forming an electrical terminal is presented herein. The method includes the step of stamping an electrical terminal preform from a sheet of metal. The electrical terminal preform having a base plate, a plurality of contact arms radially extending from the base plate, a wire attachment feature radially extending from the base plate, and a carrier strip. The base plate defines crimp wings. The method also includes the step of bending each of the plurality of contact arms to form a socket configured to receive a mating electrical terminal.

12 Claims, 6 Drawing Sheets

(56) References Cited

U.S. PATENT DOCUMENTS

| | | | |
|---|---|---|---|
| 6,607,409 | B2 | 8/2003 | Machado |
| 6,676,455 | B2 | 1/2004 | Machado |
| 8,002,593 | B2 | 8/2011 | Machado et al. |
| 8,496,503 | B2 | 7/2013 | Lamoureux et al. |
| 2003/0013352 | A1 | 1/2003 | Machado |

* cited by examiner

METHOD OF FORMING AN ELECTRICAL TERMINAL AND AN ELECTRICAL TERMINAL ASSEMBLY

CROSS-REFERENCE TO RELATED APPLICATION

This application is a divisional application and claims the benefit under 35 U.S.C. § 120 of co-pending U.S. patent application Ser. No. 16/364,547, filed Mar. 26, 2019, the entire disclosure of which is hereby incorporated by reference.

TECHNICAL FIELD OF THE INVENTION

The invention generally relates to an electrical terminal.

BACKGROUND OF THE INVENTION

Electrical devices, such as heating elements or antenna elements, are often formed on or within the front or rear windows of a motor vehicle. In order to electrically connect the on-glass elements to electrical circuitry, such as a power supply or a radio receiver/transmitter, an electrical terminal, usually a male terminal, is soldered to the glass and is electrically connected with the electrical circuitry. A female terminal at the end of a cable connected to the power supply is then mated with the male terminal located on the glass.

In some applications, the male terminal has a male cylindrical post and the mating female terminal may have a cup shaped female socket having resilient contact tabs for engaging the cylindrical post. The contact tabs are bent inwardly into the socket for resilient engagement. The cup shaped socket of the female terminal is usually staked or riveted to a separate base piece which in turn is crimped to a conductor within the cable and housed within an insulative cover. The conductor may also be soldered directly to the cup shaped socket of the female terminal.

BRIEF SUMMARY OF THE INVENTION

According an embodiment of the invention, a method of forming an electrical connector assembly is provided. The method includes the step of stamping an electrical terminal preform from a sheet of metal. The electrical terminal preform has a base plate, a plurality of contact arms radially extending from the base plate, a wire attachment feature radially extending from the base plate and defining crimp wings, and a carrier strip. The method also includes the step of bending each of the plurality of contact arms to form a serpentine shape having a convex curve and a concave curve. The plurality of contact arms define a socket configured to receive a mating electrical terminal, thereby forming an electrical terminal.

An example embodiment having one or more features of the method of the previous paragraph further includes the step of bending a portion of the wire attachment feature to form a serpentine shape having a convex curve and a concave curve, wherein the portion of the wire attachment feature is one of the contact arms in the plurality of contact arms.

An example embodiment having one or more features of the method of the previous paragraph further includes the step of forming a first aperture in the base plate.

An example embodiment having one or more features of the method of the previous paragraph further includes the step of disposing the base plate and the plurality of contact arms within a cavity of a cover formed of dielectric material.

An example embodiment having one or more features of the method of the previous paragraph further includes the step of inserting a attachment stud extending from the cover through the first aperture in the base plate. The attachment stud has a flexible first tapered member extending outwardly from the attachment stud and tapered upwardly toward a cover cap of the cover. The first tapered member engages the base plate, thereby securing the cover to the base plate.

In an example embodiment having one or more features of the electrical connector assembly of the previous paragraph, the cover defines a second aperture in the cover cap axially aligned with the first aperture in the base plate. The method further includes the step of inserting the attachment stud through the second aperture in the cover cap.

In an example embodiment having one or more features of the electrical connector assembly of the previous paragraph, the mating electrical terminal has a generally cylindrical shape with a tapered outer sidewall. The mating electrical terminal defines a third aperture axially aligned with the first aperture in the base plate and the second aperture in the cover cap. The attachment stud has a pointed tip opposite the head. The attachment stud has a flexible second tapered member extending outwardly from the attachment stud and tapered upwardly away from the pointed tip of the attachment stud. The method further includes the steps of inserting the mating electrical terminal within the socket of the electrical terminal and inserting the attachment stud extends through the third aperture in the mating electrical terminal. The second tapered member engages the mating electrical terminal, thereby further securing the cover to the mating electrical terminal.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
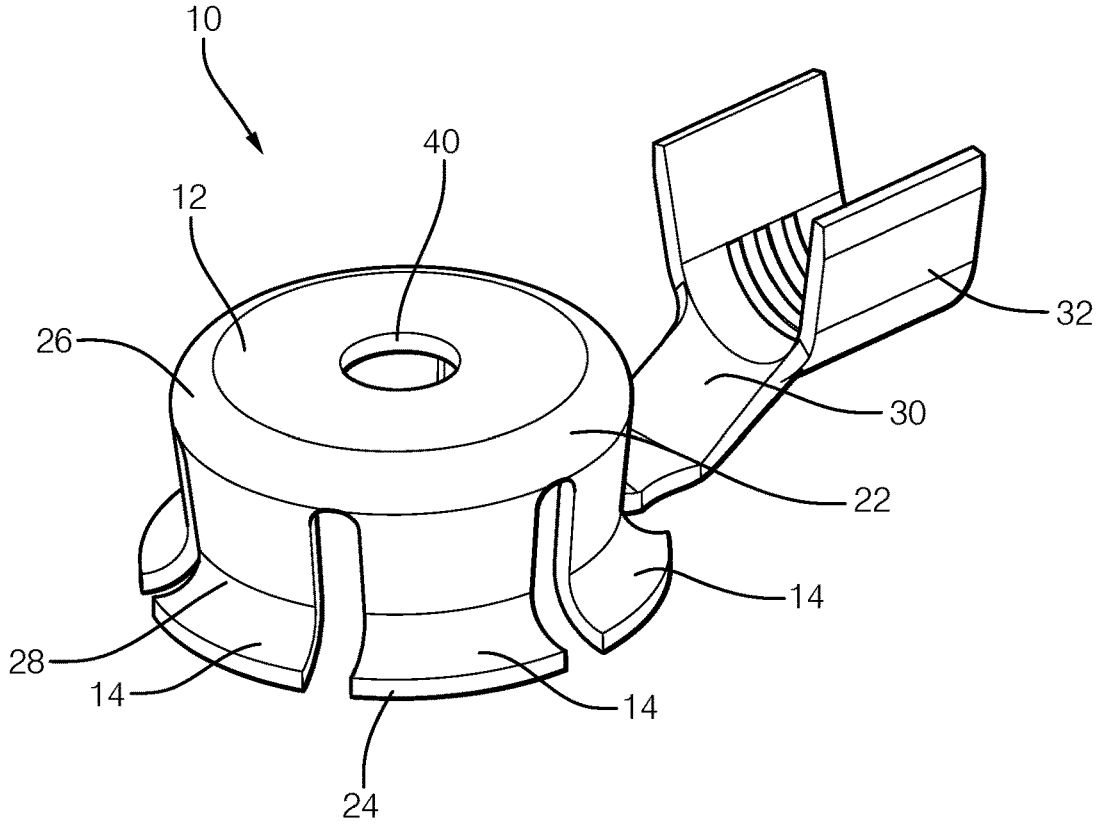
FIG. 1 is a perspective view of an electrical terminal according to one embodiment of the invention.

FIG. 1 illustrates a non-limiting example of an electrical terminal according to one or more embodiments of the invention. The electrical terminal, hereinafter referred to as the terminal 10, has a generally circular base plate 12 and a number of contact arms 14 extending from this base plate 12. The contact arms 14 are arranged around a longitudinal axis X and are evenly spaced around the longitudinal axis X. In the illustrated example there are six contact arms 14 and the contact arms 14 are spaced approximately every 60 degrees around the longitudinal axis X. The contact arms 14 form a circular female socket 16 having an opening 18 that is configured to receive and engage a mating male post electrical terminal (see FIG. 4), hereinafter referred to as the mating terminal 102. The mating terminal 102 may be soldered to a metallic contact disposed on a glass surface of an automobile (not shown). The mating terminal 102 may be electrically connected to an electrical circuit on the glass surface, such as a defroster heating element or antenna element.

Alternative embodiments of the terminal may be envisioned that have as few as three or more than six contact arms.

Each contact arm 14 has a fixed end 22 attached to the base plate 12 and a free end 24 at a distal end of the contact arm 14. Each contact arm 14 defines a convex curve 26 near the fixed end 22 and a concave curve 28 near the free end 24, thereby forming a serpentine or S-shaped curve such that the free ends 24 of the contact arms 14 extend outwardly relative to the opening 18 to allow easy insertion and removal of the mating terminal 102 from the socket 16. The distal edges of the base plate 12 are also rounded into a convex curve between the contact arms 14. The terminal 10 also includes a wire attachment feature 30 that extends from of one of the contact arms 14. The wire attachment feature 30 defines a pair or crimp wings 32 that are configured to mechanically and electrically attach the terminal 10 to a wire cable (not shown) that is electrically connected with electrical circuitry, e.g. circuitry associated with a radio receiver, radio transmitter, or defroster. As shown, the wire attachment feature 30 is longitudinally offset from the base plate 12. The wire attachment feature 30 is also longitudinally offset from the free ends 24 of the contact arms 14.

In alternative embodiments of the terminal, the wire attachment feature may further define a pair of insulation crimp wings (now shown) that are configured to attached to the insulation jacket of the wire cable. In addition or alternatively, the wire attachment feature may extend directly from the base plate rather than from one of the contact arms.

Figure 2:
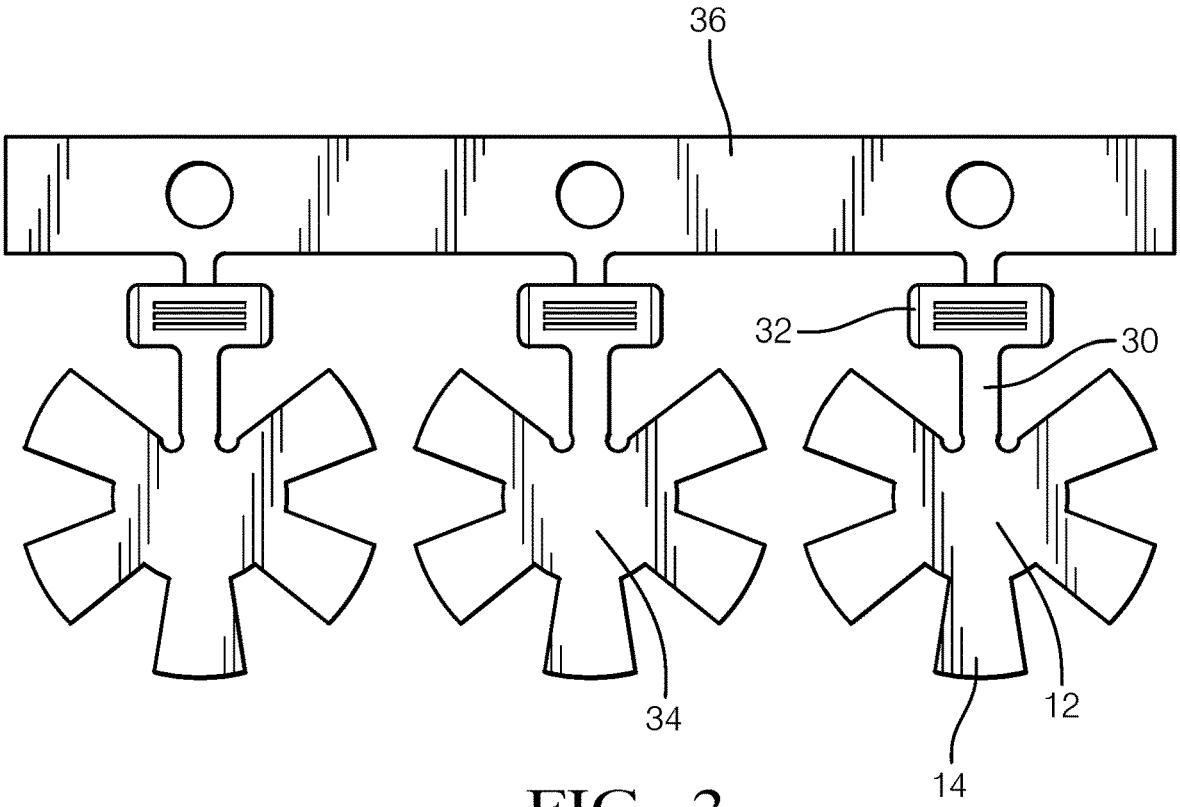
FIG. 2 is a top view of a sheet metal preform used to form the electrical terminal of FIG. 1 according to one embodiment of the invention.

The terminal 10 is formed of a single piece of sheet metal material, such as a silver plated brass material. A flat terminal preform 34, as shown in FIG. 2, is formed from the sheet metal material by a stamping or blanking process. Each terminal preform 34 is attached to a carrier strip 36 so that the terminal preforms 34 and the formed terminals 10 may be loaded onto a reel and automatically handled by terminal processing machines. The base plate 12, contact arms 14, and wire attachment feature 30 of the terminal preform 34 are then bent in a stamping and bending process by a forming die (not shown) having a series of forming steps into the desired shape of the terminal 10 shown in FIG. 1.

Figure 3:
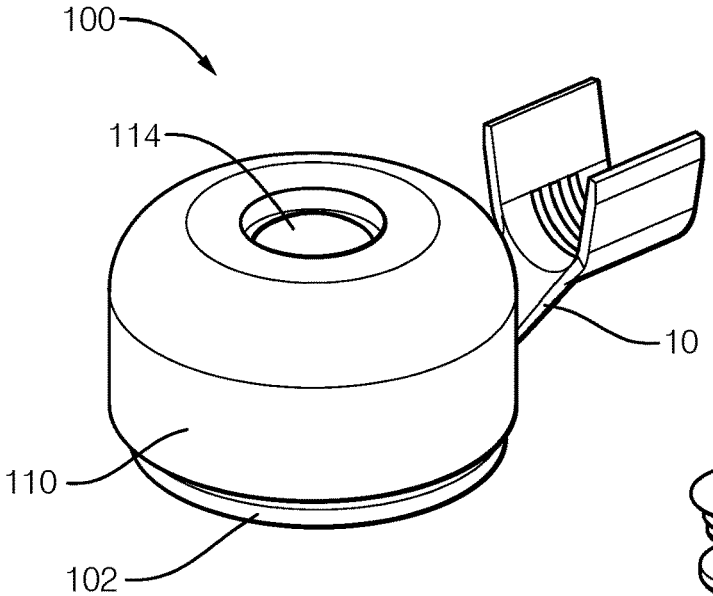
FIG. 3 is a perspective of an electrical connector assembly including the electrical terminal of FIG. 1 according to one embodiment of the invention.
Figure 4:
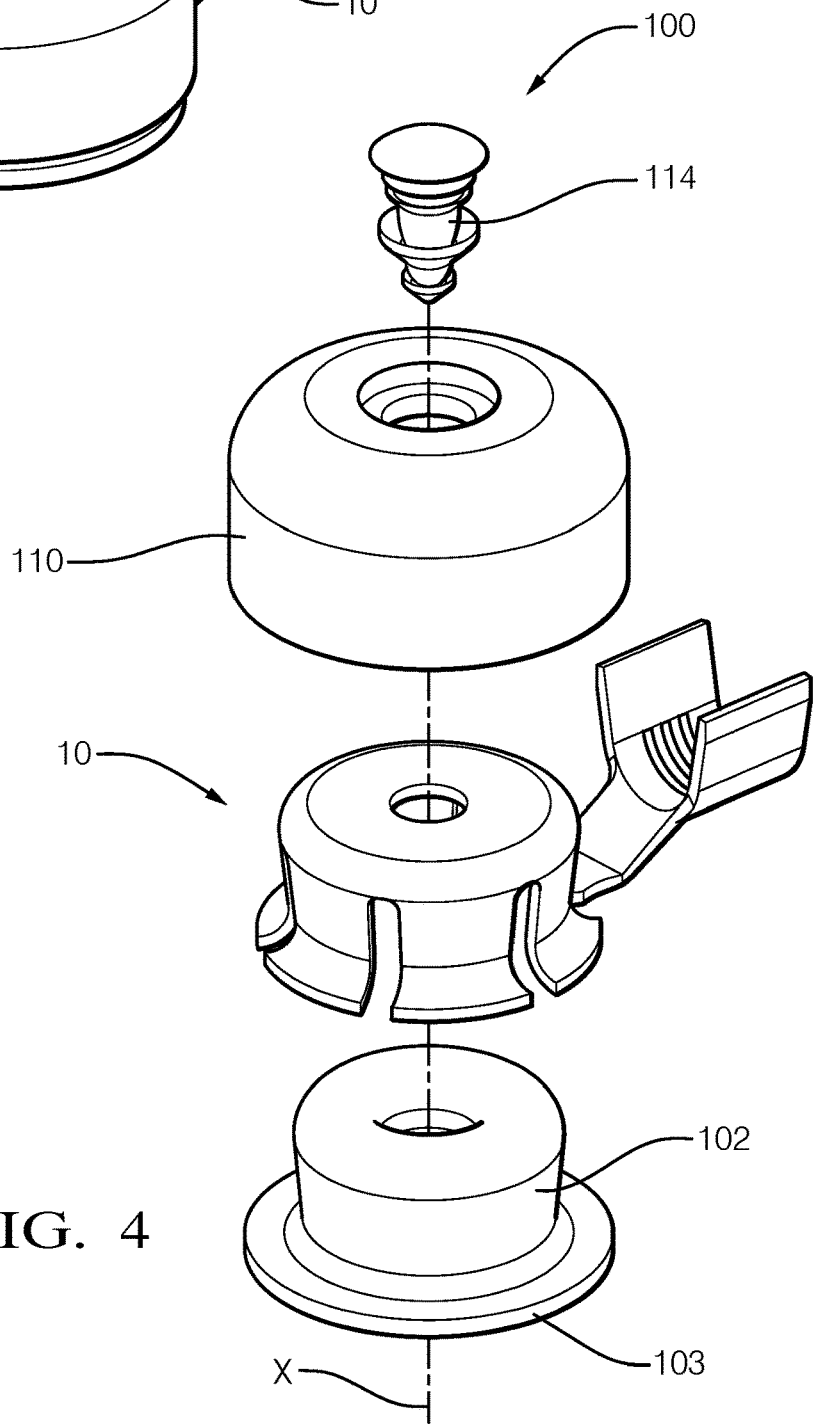
FIG. 4 is an exploded perspective view of the electrical connector assembly of FIG. 3 according to one embodiment of the invention.
Figure 5:
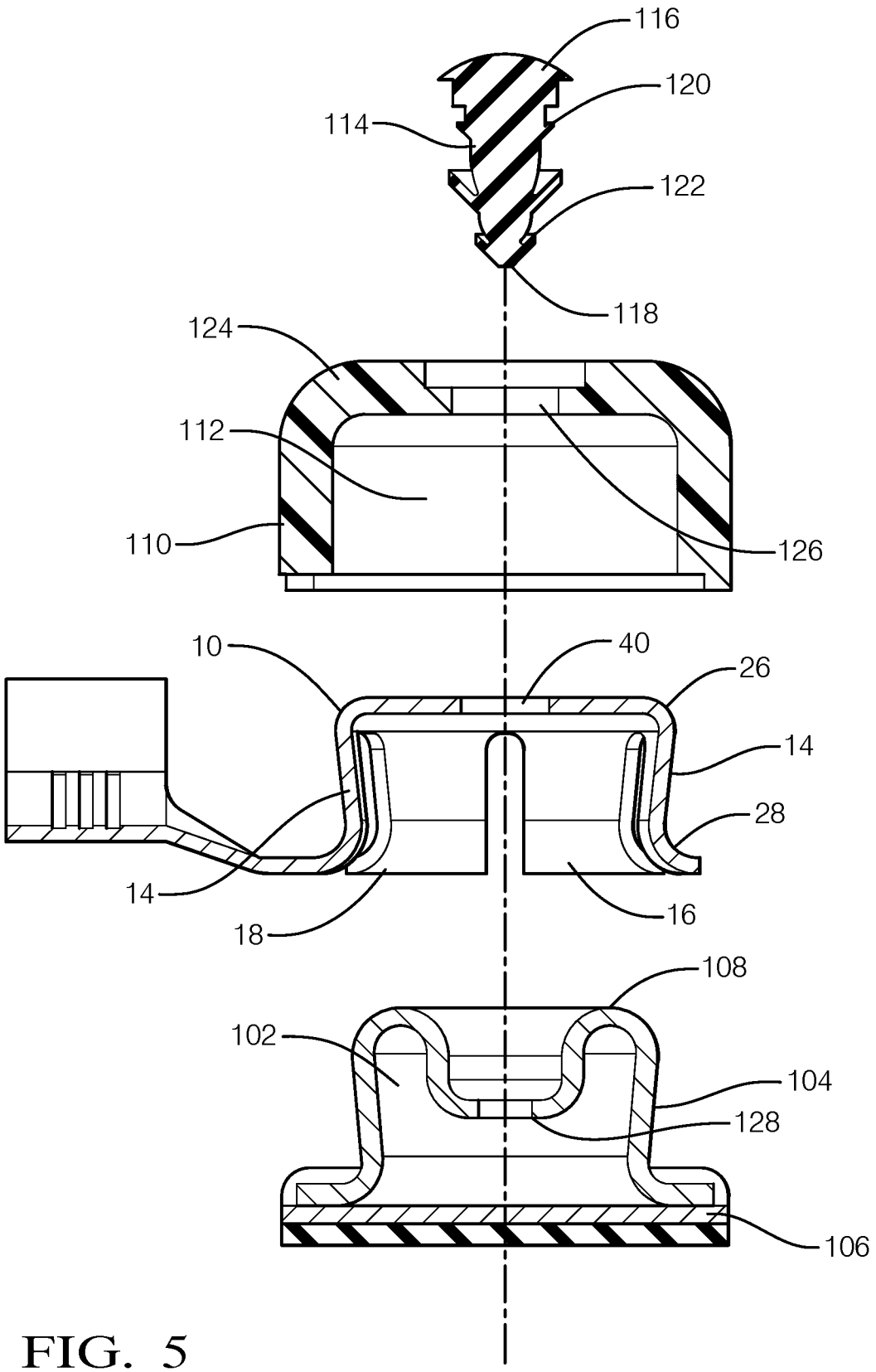
FIG. 5 is an exploded cross section view of the electrical connector assembly of FIG. 3 according to one embodiment of the invention.

FIGS. 3 and 4 illustrate a non-limiting example of an electrical connector assembly, hereinafter referred to as the connector assembly 100, that includes the terminal 10 described above. In addition to the terminal 10, the connector assembly 100 further includes the mating terminal 102 which is configured to be received within the socket 16 formed by the terminal 10. The mating terminal 102 has a generally cylindrical post shape with a tapered or flared outer sidewall 104. The sidewall 104 tapers outwardly from near the base 106 of the mating terminal 102 to the end 108 of the mating terminal 102 received within the socket 16, such that a portion of the sidewall 104 has a diameter that is less than the end 108 of the mating terminal 102. In the illustrated example the mating terminal 102 may be characterized as having a concave outer sidewall 104.

The connector assembly 100 further includes a cover 110 that is formed of a dielectric polymer material. The cover 110 defines a cavity 112 in which the base plate 12 and the plurality of contact arms 14 are received and from which the wire attachment feature 30 extends.

The cover 110 is secured to the terminal 10 and the mating terminal 102 by an attachment stud, hereinafter referred to as the stud 114. The stud 114 has a flattened head 116 on one end and a pointed tip 118 on the other. The stud 114 has a flexible first tapered member 120, in the illustrated example a flexible first tapered diaphragm encircling the shaft of the stud 114 and tapered upwardly toward the head 116 of the stud 114. The stud 114 also has a flexible second tapered member 122, in the illustrated example a flexible second tapered diaphragm encircling the shaft of the stud 114 and tapered upwardly away from the tip 118 of the stud 114. The material forming the stud 114 is also a dielectric polymer material.

Figure 6:
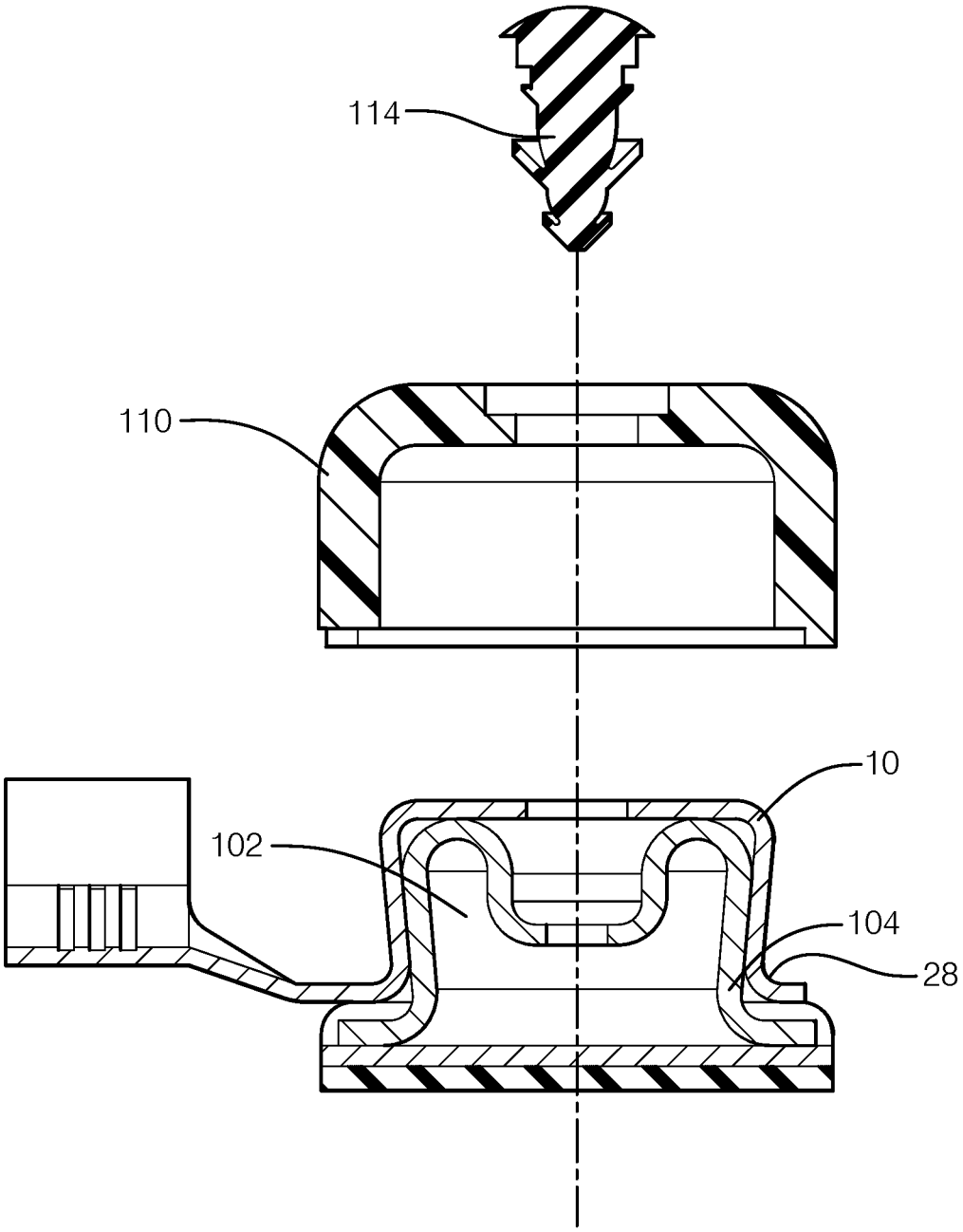
FIG. 6 is an partially assembled cross section view of the electrical connector assembly of FIG. 3 according to one embodiment of the invention.
Figure 7:
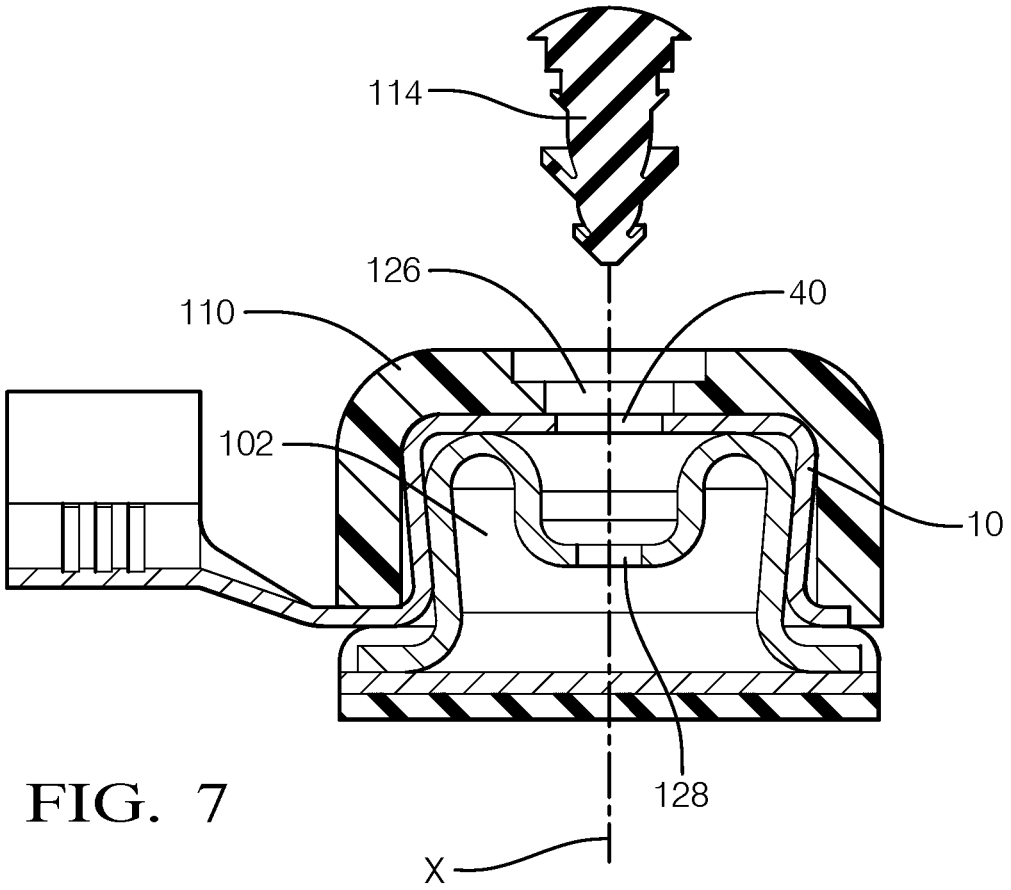
FIG. 7 is another partially assembled cross section view of the electrical connector assembly of FIG. 3 according to one embodiment of the invention.
Figure 8:
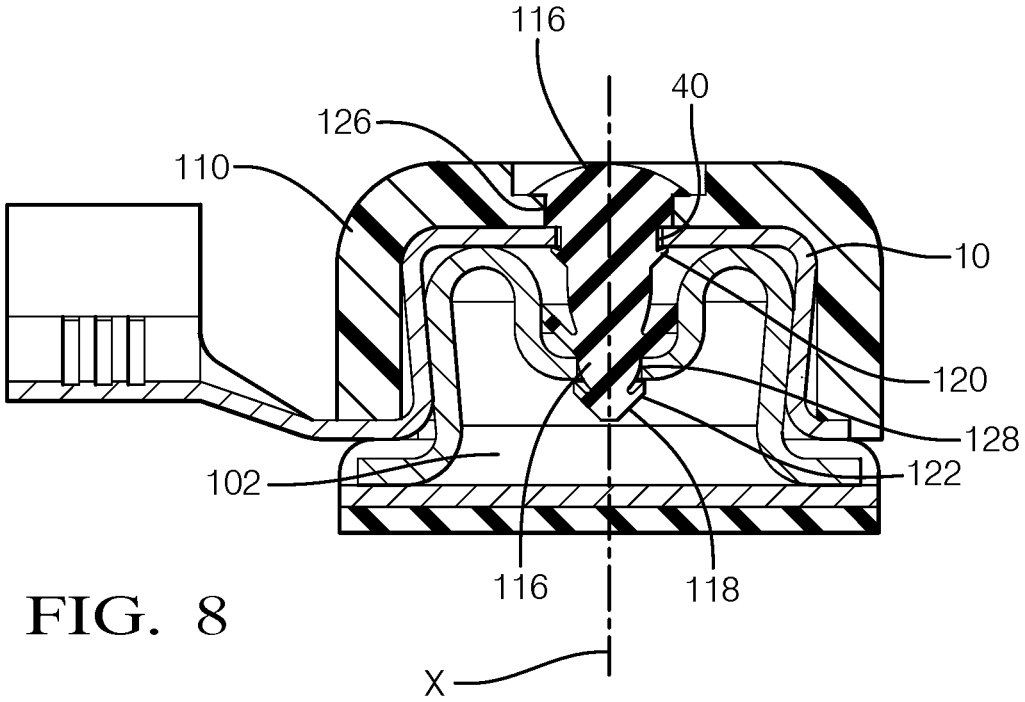
FIG. 8 is a cross section view of the electrical connector assembly of FIG. 3 according to one embodiment of the invention.

FIGS. 6 through 8 show a process of assembling the connector assembly 100. As shown in FIG. 6, the terminal 10 is first attached to the mating terminal 102. Since the diameter of the opening 18 of the socket 16 of the terminal 10 is less than the minimum diameter of the mating terminal 102, the contact arms 14 flex outwardly as the concave curved portion of the contact arms 14 contact the end 108 of the mating terminal 102. The terminal 10 then snaps in place as the contact arms 14 move down the mating terminal 102 to the tapered portion that has a smaller diameter than the end 108 of the mating terminal 102, thereby mechanically connecting the terminal 10 to the mating terminal 102. The inner apex surfaces of the concave curved portion of the contact arms 14 are in compressive contact with the mating terminal 102, thereby providing a robust electrical connection between the terminal 10 and the mating terminal 102.

As shown in FIG. 7, the base plate 12 and the plurality of contact arms 14 are placed within the cavity 112 of the cover 110.

The base plate 12 of the terminal 10 defines a circular terminal aperture 40 extending therethrough. Likewise, a cover cap 124 of the cover 110 defines a circular cover aperture 126 extending therethrough and the mating terminal 102 also defines a circular mating terminal aperture 128 extending therethrough. The terminal 10 aperture, the cover aperture 126, and the mating terminal 102 aperture are longitudinally aligned and are substantially coaxial with one another. The terminal aperture 40 has a larger diameter than the mating terminal aperture 128 and the cover aperture 126 has a larger diameter than the terminal aperture 40.

As shown in FIG. 8, the stud 114 extends through the cover aperture 126. Since the diameter of the head 116 of the stud 114 is larger than the cover aperture 126, the head 116 cannot pass through the cover aperture 126. The stud 114 also extends through the terminal aperture 40 in the base plate 12. As the first tapered member 120 is pushed through the terminal aperture 40, it flexes inwardly and then spring back once through the terminal aperture 40. The first tapered member 120 then engages the inner surface of the base plate 12. The first tapered member 120 and the head 116 cooperate to secure the cover 110 to the terminal 10. The stud 114 further extends through the mating terminal aperture 128. As the second tapered member 122 is pushed through the mating terminal aperture 128, it flexes inwardly and then spring back once through the mating terminal aperture 128. The second tapered member 122 then engages the bottom surface of the base plate 12. The second tapered member 122 and the head 116 cooperate to secure the cover 110 to the mating terminal 102 and secure the terminal 10 to the mating terminal 102.

In alternative embodiments of the connector assembly, the attachment stud may be formed by the cover cap and extends from the bottom of the cover cap. In other alternative embodiments, the first and second flexible members may be tapered fingers extending from the shaft of the stud, such as those found on "Christmas tree" fasteners commonly used in the automotive industry.

Figure 9:
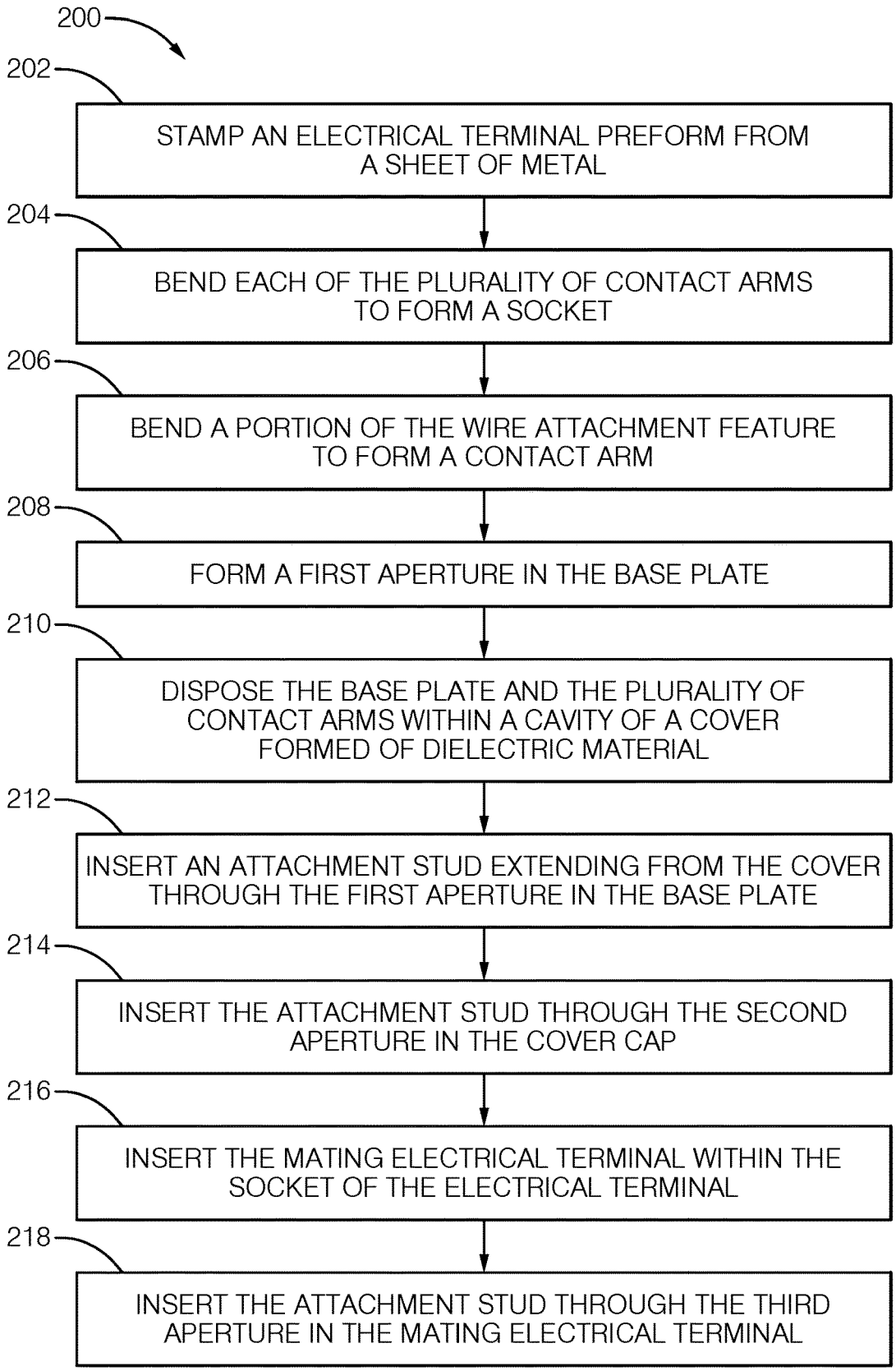
FIG. 9 is a flow chart of a method of forming an electrical connector assembly according to one embodiment of the invention.

FIG. 9 illustrates a method 200 of forming the connector assembly 100. The method 200 includes the following steps:

STEP 202, STAMP AN ELECTRICAL TERMINAL PREFORM FROM A SHEET OF METAL, includes stamping the terminal preform 34 from a sheet of metal. The terminal preform 34 has a base plate 12, a plurality of contact arms 14 radially extending from the base plate 12, a wire attachment feature 30 radially extending from the base plate 12 and defining crimp wings 32, and a carrier strip 36;

STEP 204, BEND EACH OF THE PLURALITY OF CONTACT ARMS TO FORM A SOCKET, includes bending each of the plurality of contact arms 14 to form a socket 16 configured to receive the mating terminal 102;

STEP 206, BEND A PORTION OF THE WIRE ATTACHMENT FEATURE TO FORM A CONTACT ARM, includes bending a portion of the wire attachment feature 30 to form one of the contact arms 14 in the plurality of contact arms 14;

STEP 208, FORM A FIRST APERTURE IN THE BASE PLATE, includes forming the terminal aperture 40 in the base plate 12;

STEP 210, DISPOSE THE BASE PLATE AND THE PLURALITY OF CONTACT ARMS WITHIN A CAVITY OF A COVER FORMED OF DIELECTRIC MATERIAL, includes disposing the base plate 12 and the plurality of contact arms 14 within a cavity 112 of a cover 110 formed of dielectric material;

STEP 212, INSERT A MOUNTING STUD EXTENDING FROM THE COVER THROUGH THE FIRST APERTURE IN THE BASE PLATE, includes inserting the stud 114 extending from the cover 110 through the terminal aperture 40 in the base plate 12. The stud 114 has a flexible first tapered member 120 extending outwardly from the stud 114 and tapered upwardly toward a cover cap 124 of the cover 110. The first tapered member 120 engages the base plate 12, thereby securing the cover 110 to the base plate 12;

STEP 214, INSERT THE MOUNTING STUD THROUGH THE SECOND APERTURE IN THE COVER CAP, includes inserting the stud 114 through the cover aperture 126 in the cover cap 124. The cover 110 defines the cover aperture 126 in the cover cap 124 which is axially aligned with the terminal aperture 40 in the base plate 12;

STEP 216, INSERT THE MATING ELECTRICAL TERMINAL WITHIN THE SOCKET OF THE ELECTRICAL TERMINAL, inserting the mating terminal 102 within the socket 16 of the terminal 10. The mating terminal 102 has a generally cylindrical shape with a tapered outer sidewall 104. The mating terminal 102 defines a mating terminal aperture 128 axially aligned with the terminal aperture 40 in the base plate 12 and the cover aperture 126 in the cover cap 124; and STEP 218, INSERT THE MOUNTING STUD THROUGH THE THIRD APERTURE IN THE MATING ELECTRICAL TERMINAL, includes inserting the stud 114 extends through the mating terminal aperture 128 in the mating terminal 102. The stud 114 has a pointed tip 118 opposite the head 116. The stud 114 has a flexible second tapered member 122 extending outwardly from the stud 114 and tapered upwardly away from the pointed tip 118 of the stud 114. The second tapered member 122 engages the mating terminal 102, thereby further securing the cover 110 to the mating terminal 102.

Accordingly, an electrical terminal 10, an electrical connector assembly 100, and a method 200 of forming the electrical terminal 10 and the electrical connector assembly 100 is provided. The method 200 produces a one-piece terminal 10 that provides the benefits of lower manufacturing costs and a simpler manufacturing process compared to similar prior art female terminals. The terminal 10 is also more robust and reliable and has improved electrical resistance characteristics compared to the prior art two piece terminals. The design of the terminal 10 allows a more compact cover 110, thereby providing the benefit of reduced material usage and cost for forming the cover 110 and the reduced size of the cover 110 provides a connector assembly 100 that can more easily be packaged in a vehicle. Additionally, the stud 114 provides the benefit of not only attaching the cover 110 to the terminal 10 but also attaching the terminal 10 to the mating terminal 102.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A method of forming an electrical connector assembly, comprising the steps of:

stamping an electrical terminal preform from a sheet of metal, said electrical terminal preform having a base plate, a plurality of contact arms radially extending from the base plate, a wire attachment feature radially extending from the base plate and defining crimp wings, and a carrier strip;

bending each of the plurality of contact arms to form a socket configured to receive a mating electrical terminal; and bending a portion of the wire attachment feature to form one of the contact arms in the plurality of contact arms.

2. The method according to claim 1, further comprising the step of:

forming a first aperture in the base plate.

3. The method according to claim 2, further comprising the step of:

disposing the base plate and the plurality of contact arms within a cavity of a cover formed of dielectric material.

4. The method according to claim 3, further comprising the step of:

inserting an attachment stud extending from the cover through the first aperture in the base plate, wherein the attachment stud has a flexible first tapered member extending outwardly from the attachment stud and tapered upwardly toward a cover cap of the cover and wherein the first tapered member engages the base plate, thereby securing the cover to the base plate.

5. The method according to claim 4, wherein the cover defines a second aperture in the cover cap axially aligned with the first aperture in the base plate and wherein the method further comprises the step of inserting the attachment stud through the second aperture in the cover cap.

6. The method according to claim 5, wherein the mating electrical terminal has a generally cylindrical shape with a tapered outer sidewall, wherein the mating electrical terminal defines a third aperture axially aligned with the first aperture in the base plate and the second aperture in the cover cap, wherein the attachment stud has a pointed tip opposite the head, wherein the attachment stud has a flexible second tapered member extending outwardly from the attachment stud and tapered upwardly away from the pointed tip of the attachment stud, wherein the method further includes the steps of:

inserting the mating electrical terminal within the socket of the electrical terminal; and inserting the attachment stud extends through the third aperture in the mating electrical terminal, wherein the second tapered member engages the mating electrical terminal, thereby further securing the cover to the mating electrical terminal.

7. An electrical connector assembly, formed by a process comprising the steps of:

stamping an electrical terminal preform from a sheet of metal, said electrical terminal preform having a base plate, a plurality of contact arms radially extending from the base plate, a wire attachment feature radially extending from the base plate and defining crimp wings, and a carrier strip;

bending each of the plurality of contact arms to form a socket configured to receive a mating electrical terminal; and bending a portion of the wire attachment feature to form one of the contact arms in the plurality of contact arms.

8. The electrical connector assembly according to claim 7, wherein the process further comprises the step of:

forming a first aperture in the base plate.

9. The electrical connector assembly according to claim 7, wherein the process further comprises the step of:

disposing the base plate and the plurality of contact arms within a cavity of a cover formed of dielectric material.

10. The electrical connector assembly according to claim 7, wherein the process further comprises the step of:

inserting an attachment stud extending from the cover through the first aperture in the base plate, wherein the attachment stud has a flexible first tapered member extending outwardly from the attachment stud and tapered upwardly toward a cover cap of the cover and wherein the first tapered member engages the base plate, thereby securing the cover to the base plate.

11. The electrical connector assembly according to claim 10, wherein the cover defines a second aperture in the cover cap axially aligned with the first aperture in the base plate and wherein the method further comprises the step of inserting the attachment stud through the second aperture in the cover cap.

12. The electrical connector assembly according to claim 11, wherein the mating electrical terminal has a generally cylindrical shape with a tapered outer sidewall, wherein the mating electrical terminal defines a third aperture axially aligned with the first aperture in the base plate and the second aperture in the cover cap, wherein the attachment stud has a pointed tip opposite the head, wherein the attachment stud has a flexible second tapered member extending outwardly from the attachment stud and tapered upwardly away from the pointed tip of the attachment stud, wherein the process further includes the steps of:

inserting the mating electrical terminal within the socket of the electrical terminal; and inserting the attachment stud extends through the third aperture in the mating electrical terminal, wherein the second tapered member engages the mating electrical terminal, thereby further securing the cover to the mating electrical terminal.

* * * * *